United States Patent [19]

Rumbaugh

[11] Patent Number: 4,830,107

[45] Date of Patent: May 16, 1989

[54] WELL TEST TOOL

[75] Inventor: William D. Rumbaugh, Carrollton, Tex.

[73] Assignee: Otis Engineering Corporation, Dallas, Tex.

[21] Appl. No.: 205,857

[22] Filed: Jun. 13, 1988

[51] Int. Cl.[4] ..... E21B 34/14; E21B 43/12; E21B 47/06

[52] U.S. Cl. ..... 166/250; 166/113; 166/332; 166/373; 166/385; 166/386; 166/264

[58] Field of Search ..... 166/113, 264, 250, 373, 166/385, 386, 317, 332, 142, 152; 73/151, 155

[56] References Cited

U.S. PATENT DOCUMENTS

| | | | |
|---|---|---|---|
| Re. 31,313 | 7/1983 | Fredd et al. | 166/250 |
| 3,208,531 | 9/1965 | Tamplen | 166/125 |
| 4,051,897 | 10/1977 | Kingelin | 166/125 |
| 4,134,452 | 1/1979 | Kingelin | 166/133 |
| 4,149,593 | 4/1979 | Gazda et al. | 166/113 |
| 4,159,643 | 7/1979 | Watkins | 73/155 |
| 4,373,583 | 2/1983 | Waters | 166/113 |
| 4,453,599 | 6/1984 | Fredd | 166/374 |
| 4,487,261 | 12/1984 | Gazda | 166/264 |
| 4,506,731 | 3/1985 | Skinner | 166/250 X |
| 4,508,174 | 4/1985 | Skinner et al. | 166/373 |
| 4,583,592 | 4/1986 | Gazda et al. | 166/250 |
| 4,669,537 | 6/1987 | Rumbaugh | 166/385 X |

*Primary Examiner*—Bruce M. Kisliuk
*Attorney, Agent, or Firm*—Albert W. Carroll

[57] ABSTRACT

A well test tool including a valve lowerable into a well on a flexible line and locked and sealed in a downhole landing receptacle, the valve being openable and closable to permit or prevent flow therethrough, well pressures below the test tool being sensed and recorded by a recording pressure gage both during periods of flow and during shut-in periods, the recording pressure gage being either carried by the test tool as a part thereof or being supported in the well independent of the test tool, the valve of the test tool being shiftable between open and closed positions by suitable tools lowered into the well on the flexible line, the flexible line and tools being not required in the well during either of the shut-in or flow periods, excepting only during the shifting operation, thus permitting the flexible line to be slacked during such flow or shut-in periods, or removed from the well altogether. In either case, the well test will be unaffected by movement (as by wind, wave, or similar forces) of super craft on which the flexible line reel and equipment, and personnel relating thereto, may be carried.

25 Claims, 9 Drawing Sheets

WELL TEST TOOL

BACKGROUND OF THE INVENTION

1. Field of the Invention

This invention relates to well tools, and more particularly to downhole shut-in tools for use in testing subterranian formations such as those penetrated by oil or gas wells.

2. Description of the Related Art

For a number of years, well test tools have been lowered into wells on flexible lines for conducting various types of tests in order to gather physical information which would make possible a reasonable evaluation of the hydrocarbon bearing formation penetrated by the well.

Some of the test tools are electrically powered and have instruments which can sense well characteristics and can generate and send up signals suitable for processing by surface readout equipment. Such tools, understandably, must be lowered into the well on an electrical cable which must remain attached to the test tool. Some others of the test tools are mechanically actuated or partially battery-powered and are run on a conventional single strand wire line (commonly called a "slick line") which remains attached to the test tool. Some of the test tools have the capability of gathering information concerning pressures and/or temperatures, can shut-in the well at a downhole location, and have means for equalizing pressures thereacross prior to retrieving the test tool, but many of these tools have a very small flow capacity. Some of the test tools can be cycled between open and closed as many times as desired; others are installed and then closed, never to be cycled further.

Following is a list of prior art patents with which applicant is familiar.

| | | | |
|---|---|---|---|
| Re.31,313 | 3,208,531 | 4,051,897 | 4,134,452 |
| 4,149,593 | 4,159,643 | 4,373,583 | 4,453,559 |
| 4,487,261 | 4,508,174 | 4,583,592 | |

U.S. Pat. No. Re. 31,313 issued to John V. Fredd on July 19, 1983, the original U.S. Pat. No. 4,274,485 having issued to him on June 23, 1981. This patent teaches a test tool which may be installed in a well, after which a probe including pressure sensing means (a recording pressure instrument, or an electronic sensor which will send signals via the electric cable to surface readout equipment for processing, display, and/or recording, for instance, may be run on a flexible line to engage the probe in the test tool for opening and closing the test tool by tensioning or slacking the flexible line. The flexible line must remain attached to the probe in order to actuate the test tool.

U.S. Pat. No. 3,208,531 issued to Jack W. Tamplen on Sept. 28, 1965 and teaches one type of locking device on which test tools such as the test tool of the present invention can be run and installed in a well.

U.S. Pat. No. 4,149,593 issued to Imre I. Gazda and George F. Kingelin on Apr. 17, 1979 and covers a test tool which may be run on a wire line and installed in a well for shutting-in the well or opening it to flow at a downhole location by tensioning and relaxing the wire line. The test tool can be opened and closed any number of times, but the wire line must remain attached to the test tool.

U.S. Pat. No. 4,051,897 issued on Oct. 4, 1977 to George F. Kingelin and teaches a test tool including a lock device anchored in sealed relation in a landing receptacle downhole in a well, and a probe including pressure or temperature sensor transducer and a probe portion having a valve therein, to be lowered into the well on an electrical cable and engaged in the lock device. Then, by tensioning and relaxing the electric cable, the valve in the probe is opened and closed--closed to permit pressure to build therebelow and opened to permit pressures to equalize thereacross preparatory to removing the test tool from the well. The sensor means continuously generates signals which are sent to the surface via the cable for real time readout of the conditions sensed.

U.S. Pat. No. 4,134,452 issued Jan. 16, 1979 to George F. Kingelin. The disclosed invention is an improvement over the invention of U.S. Pat. No. 4,051,897, and although the structure differs in certain details, the test tool accomplished the same purpose.

U.S. Pat. No. 4,159,643 issued to Fred E. Watkins on July 3, 1979 and covers a test tool which is first installed in a well, then a probe including a sensor prong is lowered on an electric cable and latched into the test tool. Tensioning the cable then closes to test tool and signals sent to the surface indicate the pressures below the test tool. The test tool can be actuated from open to closed position only once. At the end of the test, the instrument portion of the sensor prong can be retrieved. Afterwards the prong is retrieve.

U.S. Pat. No. 4,373,583 issued to Fleming A. Waters on Feb. 15, 1983 and covers a test tool installable in a well, the test tool having a valve therein initially in open position and which can be later engaged by a probe and lifted to closed position. The probe can at the conclusion of the test be disconnected from the valve and removed from the well. The valve cannot be reopened although an equalizing valve in the test tool can be opened by a prong on a retrieving tool prior to retrieving the test tool. Thus, the well can be flowed through the initially open valve to record one phase of the well test, then the valve can be closed to stop flow for a second phase of the test during which the instrument records the build-up in pressure below the test tool, but the valve is not intended to be cycled other than being closed just the once. The wire line and probe may be detached from the tool or left attached thereto, as desired, during the shut-in phase of the well test. The present invention is an improvement over the invention disclosed in patent No. 4,373,583 to Fleming A. Waters.

U.S. Pat. No. 4,453,599 issued to John V. Fredd on June 12, 1984 and is cited herein becauses of its teaching of a shutter mechanism which makes it possible to slide a resilient seal ring past a sizeable flow port under conditions of flow without damaging the seal ring. Although a measuring instrument is shown on a flexible line, neither the instrument nor the flexible line is used to actuate the downhole valve which is, instead, pressure actuated.

U.S. Pat. No. 4,487,261 issued to Imre I. Gazda on Dec. 11, 1984 and discloses a test tool run into a well on a flexible line and engaged in a receptacle. When the flexible line is relaxed the test tool opens and when the flexible line is tensioned the test tool closes. The flexible line must remain attached to the test tool in order to actuate it.

U.S. Pat. No. 4,508,174 issued on Apr. 2, 1982 to Neil G. Skinner and David S. Wesson for a downhole test tool which includes a downhole valve and related elements including a receptacle, together with a probe portion including sensor means. The probe is lowerable into the well on a flexible line and is engaged in the receptacle. An upward pull on the flexible line opens a spring-biased slide valve to let formation pressure reach the pressure sensor. Relaxing the flexible line allows a spring to close the slide valve. The well cannot flow at any position of the test valve since the probe fills the receptacle bore. The flexible line cannot be detached from the probe, for this would allow the slide valve to close. The ball valve shown below the test tool is for use in performing drill stem tests and is operated independently of the test tool by other means, such as annulus pressure, the test tool being used to observe pressure build-up beneath the closed ball valve. This invention bears little resemblance to the present invention.

U.S. Pat. No. 4,583,592 issued Apr. 22, 1986 to Imre I. Gazda and Phillip S. Sizer and covers a test tool which may be run into a well for engagement in a downhole receptacle for shutting in the well when the flexible line is tensioned and for opening the well to flow when the flexible line is relaxed. The flexible line must remain attached to the test tool in order to actuate it. The test tool can be cycled between open and closed positions several times before disengaging the landing receptacle, but it can be reengaged as desired for additional cycles. The receptacle comprises telescoping sections which provide an extremely large bypass, thus to provide a flow capacity as great as that of the well tubing.

U.S. Pat. Nos. 3,208,531 to Tamplen, 4,373,583 to Waters, and 4,453,599 to Fredd are incorporated herein by reference thereto for all purposes.

There is not found in the known prior art a well test tool which can be run into a well on a flexible line, installed in a downhole receptacle therein, and cycled as many times as necessary between open and closed positions to allow or prevent flow therethrough, without requiring the presence of the flexible line in the well except as it is required to shift the test tool between open and closed positions.

SUMMARY OF THE INVENTION

The present invention is directed to test tools, and landing nipples and shifting tools therefor, for testing wells, and to methods and systems for testing wells made possible by the test tools of the present invention, the test tools having a tubular housing open at the upper end and closed at the lower end with a lateral flow port in its wall and attachable to a lock device which is installable in a well flow conductor in locked and sealed relation therewith, a slide valve in the body slidable between positions opening and closing the lateral flow port, the slide valve being shiftable between open and closed positions through use of shifting tools lowered into the well on a flexible line, the flexible line being removable from the well each time after the valve has been shifted, there being a recording instrument associated with the test tool (either attached thereto or suspended in the well therebelow) for recording certain well characteristics.

It is therefore one object of this invention to provide an improved well test tool and receptacle therefor which are useful in obtaining reservoir information in a well by shutting in the well at a location substantially adjacent the formation to be tested and allowing flow to take place through the test tool, and recording continuously well characteristics during both the shut-in periods and the flow periods during the testing procedure.

Another object is to provide such a test tool which is run into a well on a flexible line but which does not require the presence of the flexible line in the well during the testing procedure except for the actual opening and closing of the test tool.

Another object is to provide such a test tool which is short in length, simple in structure, reliable in operation, and economical to use, the flexible line and related equipment not being needed on the well being tested during long shut-in or flow periods.

Another object is to provide such a test tool utilizing common resilient seals such as O-ring seals and a shutter mechanism for substantially shutting off fluid flow through its lateral flow port and then protecting the resilient seal from damage as it is moved past the lateral flow port.

Another object is to provide such a test tool which has a large flow capacity.

Another object is to provide such a test tool which is useful not only in conducting production-type tests but which can be used also in conducting injection-type tests.

Another object is to provide modified test tool which is useful primarily in conducting injection-type tests but which can be used also in conducting production-type tests.

A further object is to provide test tools of the character disclosed which may carry a recording instrument attached thereto and supported thereby, or may not have the recording instrument attached thereto, in which case the recording instrument is supported in the well below the test tool by means other than the test tool.

Another object is to provide well test systems utilizing improved test tools of the character described.

A further object is to provide methods of carrying out production-type tests in wells utilizing improved test tools and systems of the character described.

Another object is to provide methods of carrying out injection-type tests in wells utilizing improved test tools and systems of the character described.

Further objects and advantages will become apparent from reading the description which follows and from studying the accompanying drawing, wherein:

DESCRIPTION OF THE PREFERRED EMBODIMENTS

Figure 1:
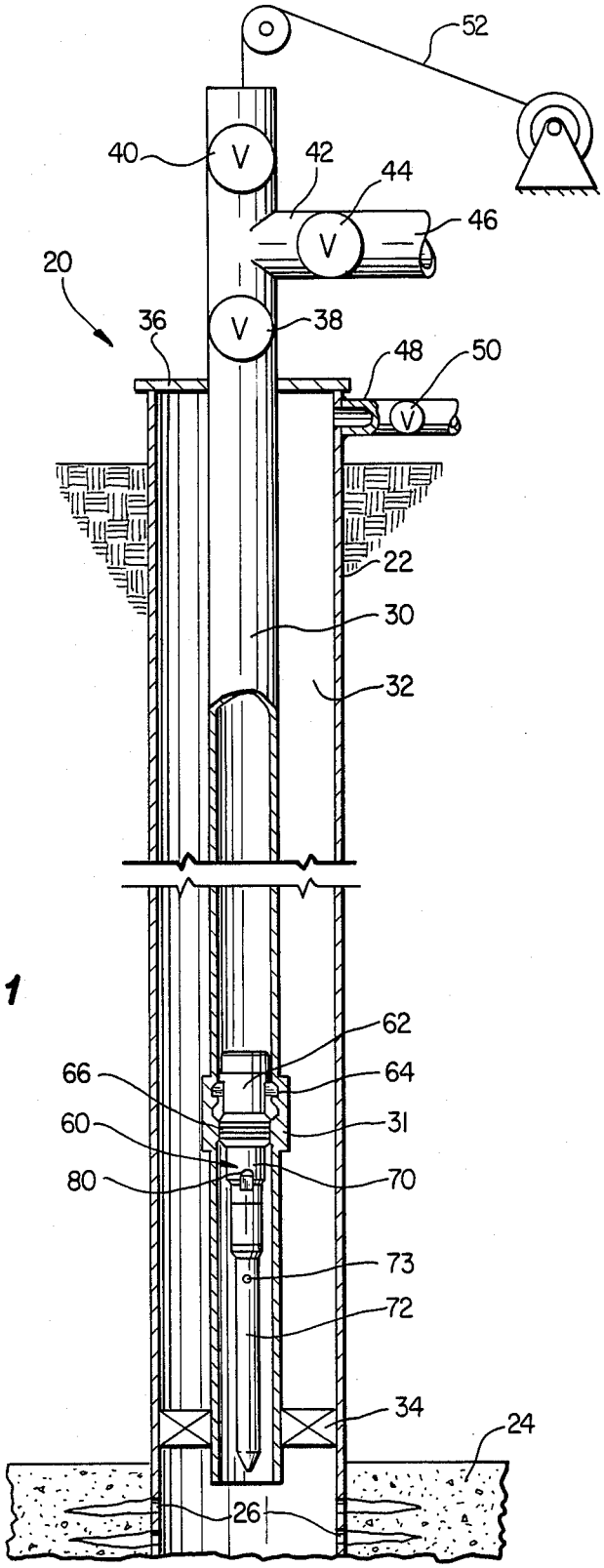
FIG. 1 is a schematical view showing a well with a test tool of this invention installed therein and ready to perform well test methods of this invention.

Referring now to FIG. 1, it will be seen that a well 20 is schematically shown to be constructed with a casing 22 which penetrates an earth formation 24, which bears production fluids such as hydrocarbons (oil or gas), or water, carbon dioxide, or helium for example, and is perforated as at 26 opposite such formation 24.

A well tubing 30, having a landing receptacle as at 31, is disposed in the casing 22 providing an annulus 32 therebetween. The annulus 32 is closed at its lower end by a packer 34 and is closed at its upper end by a wellhead 36 while, above the wellhead, surface connections, such as a Christmas tree, are provided and include a master valve 38, swab valve 40, a wing 42, wing valve 44, and flow line 46. Just below the wellhead 36, the casing 22 is provided with a casing wing 48 and a casing wing valve 50.

The casing wing valve 50 provides access to the upper end of the annulus 32 as needed, while the master valve provides access to the well tubing 30 and the region below the packer with which it is in constant communication. With the master valve 30 open, the wing valve 44 is openable to permit flow from the well tubing or to permit injection of fluids into the well tubing. The swab valve is openable to permit lowering well tools into the well as by flexible line 52 and in the conventional manner, using proper equipment (not shown) to maintain control of the well, of course.

In FIG. 1, a test tool assembly 60 is shown to be supported in the landing receptacle 31. More specifically, the test tool assembly includes a lock device 62 anchored by lock keys 64 engaged in suitable lock recesses and is sealed by seal rings 66 sealingly engaged with the inner wall of the landing receptacle 31. The test tool 70 is attached to the lower end of lock device 62 and is supported thereby. A recording instrument 72 including sensor means responsive to one or more well characteristics such as pressure, temperature, or the like, is attached to the lower end of the test tool 70. As shown, instrument 72 is meant to represent a recording bottom hole pressure gage.

The test tool assembly 60 was lowered into the well and installed in the landing receptacle through use of flexible line 52 and flexible line tools (not shown).

Production fluids from the formation 24 enter the well casing 22 through the perforations 26 and normally flow upwardly through the tubing 30, master valve 38, wing valve 44 and flow line 46. Of course, when the test tool assembly 60 is anchored and sealed in the landing receptacle, as shown, all such production fluids must pass therethrough. Thus, production fluids must enter the inlet ports 80 of the test tool 70 and exit at the open upper end of the lock device 62. However, the test tool 70 is provided with a valve (not shown) which can be opened or closed to control flow into inlet ports 80. When, of course, the valve is closed, no flow can take place through the inlet ports and the well is thus shut in at the test tool location. Well pressure then builds below the test tool and packer and in a relatively short period of time stabilizes with the formation pressure. Thus, the effects caused by well bore storage are avoided.

Similarly, when the valve of the test tool is again opened, flow is again established through the test tool and pressure therebelow begins to fall off. In time, the well pressure below the test tool stabilize and such fall-off ceases.

The valve (not shown) of the test tool may be opened and closed as desired through use of suitable opening and closing tools lowered into the well on the flexible line 52 to, thus, control the well for testing the formation 24 in the manner desired.

The pressure gage 72 has a communication port 73 for communicating well pressure to the sensor means inside the instrument.

Figure 2A:
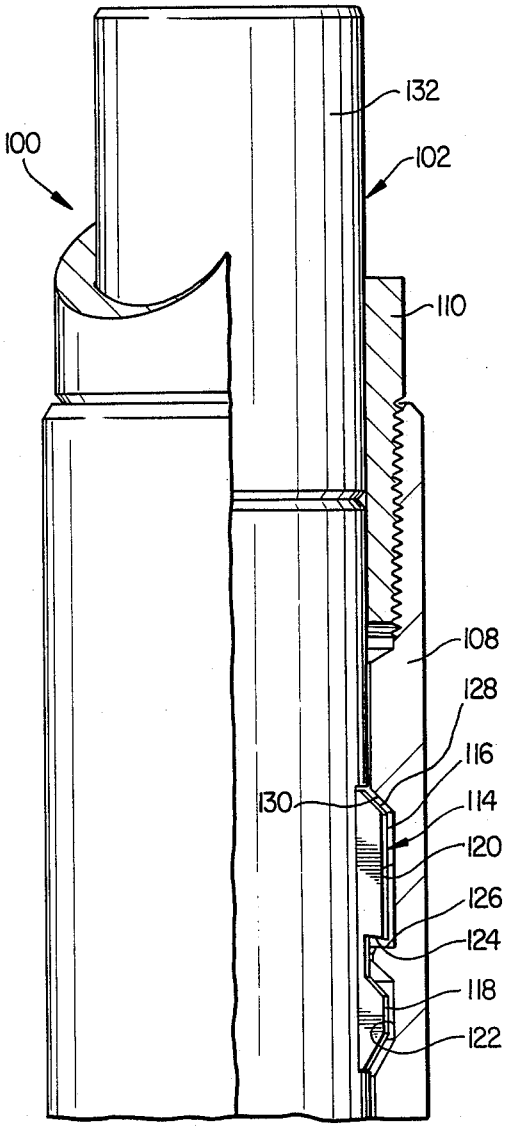
FIGS. 2A, 2B, and 2C, taken together, constitute a longitudinal view, partly i section and partly in elevation with some parts broken away, showing a test tool constructed in accordance with this invention.
Figure 2B:
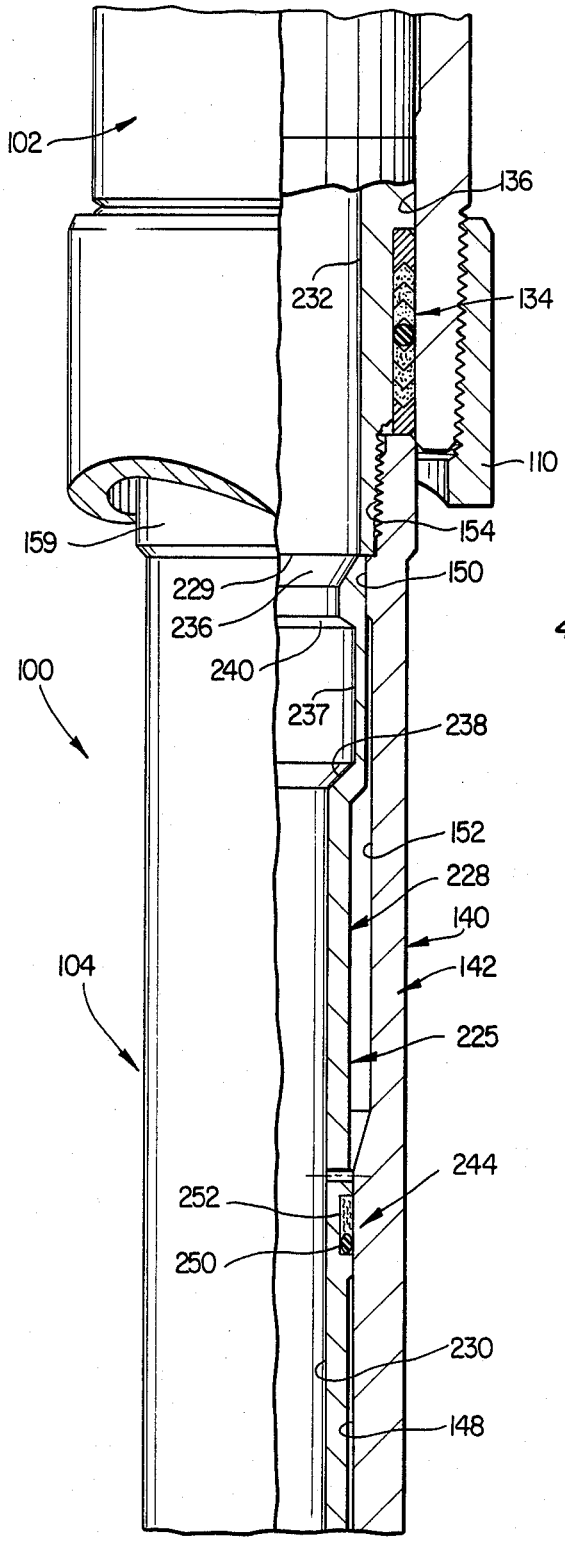
Figure 2C:
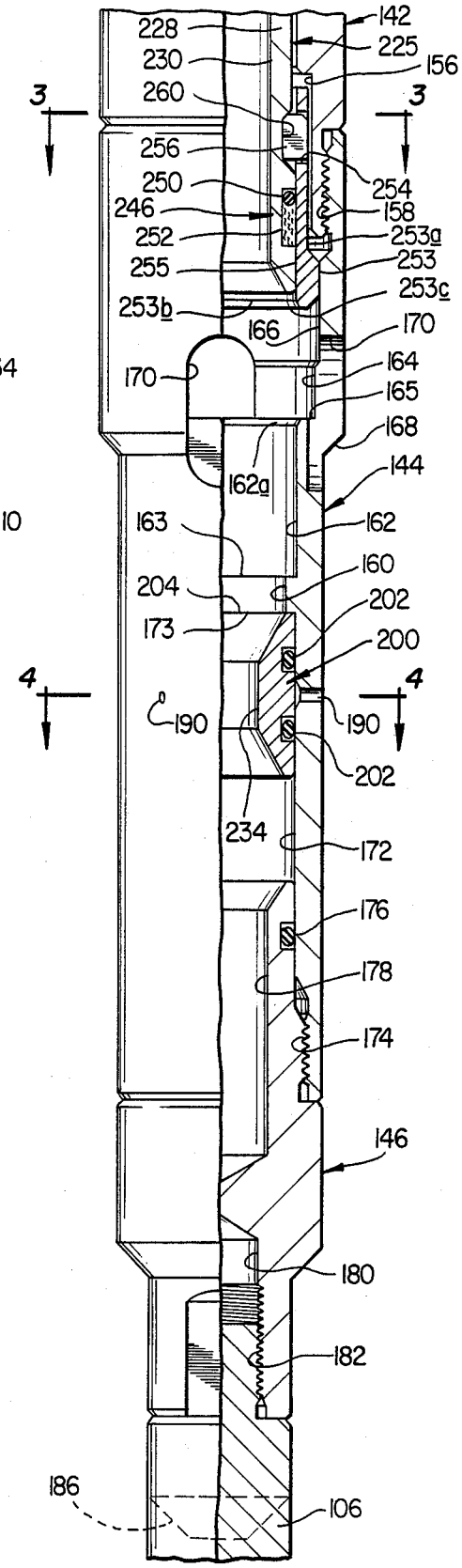

The test tool assembly is shown in FIGS. 2A–2C where it is indicated by the reference numeral 100. (Test tool 100 is intended for use in testing production wells, but can be adapted for use in testing injection wells, however, use of a modified test tool (seen in FIGS. 18 and 19) may be desirable instead for use in testing injection wells. (This will be explained more fully later.) The test tool assembly includes lock device 102, test tool 104 and recording instrument 106. The test tool assembly is shown to be installed in a landing receptacle 108 which forms a part of tubing 110.

The landing receptacle 108 and the lock device 102 may be of any suitable type, the type shown being that disclosed in U.S. Pat. No. 3,208,531 which is incorporated herein by reference. The lock device in any event must be compatible with the landing receptacle, and is shown to be the Otis Type X Locking Mandrel. Type X Landing Nipples and Locking Mandrels as well as other suitable landing nipples and locking mandrels therefor are available from Otis Engineering Corporation, Dallas, Texas.

Lock device 102 includes locking keys 114 having external bosses 116 and 118 which are engaged in corresponding recesses 120 and 122, respectively, of the landing receptacle 108. The upper boss 116 of the key has a downwardly facing abrupt shoulder 124 engageable with abrupt upwardly facing shoulder 126 of the landing receptacle to prohibit downward movement of the lock device in the landing receptacle, while upward movement is prevented by engagement of the inclined shoulder 128 of the locking key 114 with the corresponding inclined shoulder 130 at the upper end of upper recess 120. The locking keys are maintained against inward movement by an expander sleeve, the upper end of which is indicated at 132. Near its lower end, the lock device is provided with suitable seal means, such as packing assembly 134 which seals between the device and the polished bore 136 of the receptacle 108. The lock device 102 is installed through use of the Otis Type X Running Tool and is released and removed through use of the Otis GS Pulling Tool, both of which are available from Otis Engineering Corporation, supra. See U.S. Pat. No. 3,208,531.

The test tool 104 includes a housing 140 comprising an upper housing section 142, a lower housing section 144, and a lower sub 146.

Upper housing section 142 is provided with a smooth bore 148 and this bore is enlarged at its upper end as at 150, and further enlarged as at 152 to provide relief. Above the bore portion 150, the bore is further enlarged and internally threaded as at 154 for attachment to the lock device as shown. The lower end of the bore 148 is counterbored as at 156 for a purpose to be explained later and the lower end of the housing is reduced in outside diameter and externally threaded as at 158 for attachment of the lower housing section 144 of the housing. Preferably, the upper housing has its upper end portion enlarged as at 159 providing a downwardly facing external annular shoulder 159*a*.

Lower housing section 144 is provided with a bore 160 which is enlarged thereabove as at 162, providing an upwardly facing stop shoulder 163 and is further enlarged as at 164 providing an internal annular upwardly facing seat 165. The short bore portion 164 and the seat 165 are very carefully made for a reason soon to be brought to light. Above enlarged bore 164 the bore is loosened up considerably as at 166 and is internally threaded as at 158 for attachment to the upper housing section 152. The lower housing section 144 is reduced in outside diameter just below its upper end and more specifically just below internal upwardly facing seat 165, as shown, providing an external downwardly facing shoulder 168. Lateral flow ports 170 are formed through the wall of lower housing section 144 for communicating the exterior of the housing with its interior. As shown, flow ports 170 are formed as by running a mill cutter inward through the housing wall at a location just above seat 165 and then moving it longitudinally downwardly to elongate the opening. Thus the mill cutter forms a slot extending downwardly beyond seat 165 since the cutter does not extend inwardly sufficiently to destroy seat 165. The slot thus formed extends below external downwardly facing shoulder 168 to enhance the flow path leading to the lateral flow ports 170.

Bore 160 is enlarged therebelow as at 172 to provide internal downwardly facing shoulder 173 and is internally threaded as at 174 for attachment of the lower sub 146 as shown. O-ring 176 seals the connection.

The lower sub 146 has a blind bore 178 opening upwardly and a blind bore 180 opening downwardly, this downwardly opening bore being internally threaded as at 182 to receive a member such as, for example, a recording pressure gage 106, or other suitable instrument. In the absence of such an instrument, a plug such as plug 186 may be threaded into the lower end of the housing to protect internal thread 182, and if the test tool is to be lowered into a well, the plug 186 will also help to guide the test tool in its descent.

Upwardly opening blind bore 178 of lower sub 146 provides a chamber in which solids, such as sand, trash, et cetera, may settle and collect to thus prevent them from fouling the test tool, especially the sliding valve 225, shutter 253, and equalizing valve 200, or any of the tools used therewith, or interfering with the proper operations thereof.

Figure 4:
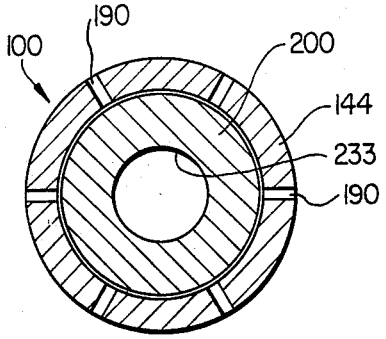
FIG. 4 is an enlarged cross-sectional view taken along line 4—4 of FIG. 2C.

Equalizing ports are formed through the wall of the ported section 144 of the housing as at 190 (see also FIG. 4) a short distance below internal downwardly facing shoulder 173 and an equalizing valve 200 having a pair of suitable seal rings such as o-rings 202 is positioned in bore 172 with its upper end 204 substantially abutting downwardly facing shoulder 173 and with its o-rings 202 sealing above and below equalizing ports 190 to prevent leakage of well fluids therethrough. The o-rings 202 are an interference fit in bore 172 and provide adequate friction for maintaining the equalizing valve 200 in the position shown until displaced from such position for equalization of pressures above and below the test tool.

Fluid flow through the lateral flow ports 170 is controllable by sleeve valve means 225 in a manner soon to be explained.

Sleeve valve means 225 is disposed within the housing 140 and is slidable therein between its upper position, shown in FIGS. 2B and 2C in which position the upper end of the valve body 228 substantially abuts the lower end 229 of lock device 102, and the lateral flow ports 170 are open or uncovered for fluid flow therethrough, (this may be called the open position for the sleeve valve or for the test tool) and its lower position, in which the lower end of valve body 228 abuts or substantially abuts the internal upwardly facing shoulder 163, and the lateral flow ports 170 are covered and fluid flow therethrough is prohibited. (This may be called the closed position of the sleeve valve or of the test tool.) Sleeve valve means 225 is similar to that disclosed in U.S. Pat. No. 4,373,583 incorporated herein by reference.

Valve body 228 is provided with an internal bore 230 which is a little smaller in diameter than the bore 232 of the lock device 102 but a little larger than the bore 234 through the equalizing valve 200. Bore 230 of valve body 228 is flared at its upper en as at 236, and a short distance below the upper end of the valve body an internal recess 237 is formed to provide an internal upwardly facing shoulder 238 to be engaged by a suitable flexible line tool for forcing the sleeve valve means 225 to its lower position, and an internal downwardly facing shoulder as at 240 to be engaged by a suitable flexible line tool for forcing the sleeve valve means 225 to its upper position within the housing 140.

Valve body 228 is provided with upper and lower spaced apart resilient seal means as at 244 and 246, respectively, as shown. Upper seal means 244 may include an o-ring 250 and a special back-up ring such as ring 252 made of a suitable material. Two suitable materials for back-up ring 252 are RYTON (Polyphenelene Sulfide) or PEEK (Polyetheretherketon). Both RYTON and PEEK are readily available from firms which supply industrial chemicals. Lower seal means 246 likewise includes an o-ring 250 and a back-up ring 252. The sole difference between these two seal means is that the upper seal means has its back-up ring is on the upper side of the o-ring while the lower seal means has its back-up ring is on the lower side of the o-ring, as clearly seen in FIGS. 2B and 2C. (If injection testing is to be performed using test tool 100, the relative positions of the o-rings and back-up rings in the seal means 244 and 246 should be reversed since the pressure inside the test tool may, at times, exceed that exterior thereof. Thus, in the upper seal means 244, the o-ring would be above the back-up ring and in the lower seal means 246, the o-ring would be below the back-up ring.) It may be desirable to provide a back-up ring 252 on both sides of each o-ring 250 to enable the test to withstand differential pressures in either direction such as may be encountered in production testing and/or injection testing. This would necessitate widening of the seal recesses of the valve body 228, but would obviate the need to rearrange the seals when changing test types.

Figure 3:
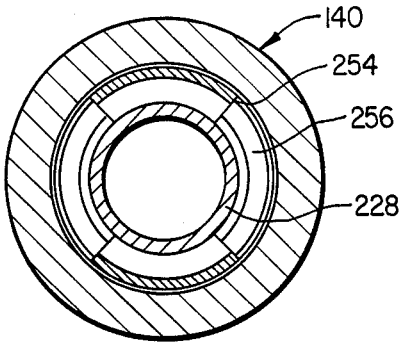
FIG. 3 is an enlarged cross-sectional view taken along line 3—3 of FIG. 2C.

The sliding valve 225 carries a shutter mechanism which makes it possible to use a resilient seal such as an o-ring which must be moved past the lateral flow ports 170 even with a tremendous differential pressure existing thereacross. Thus, the valve body 228 carries a shutter 253 which surrounds its lower end portion and covers the lower seal means 246 when the valve is in its upper position, as shown. The upper portion of the shutter 233 is reduced in outside diameter as at 253*a* and extends upwardly beyond the lower seal means 246. Near its upper end, the shutter 253 is provided with at least one and preferably at least two windows 254 in each of which is a locking lug 256 which may be in the form of a ring segment. See also FIG. 3. These locking lugs 256 are slidable radially in the windows between inner and outer positions. In FIG. 2C, it is seen that since the valve is in its upper position and the upper portion of the shutter 253 is housed in enlarged bore 156 of the upper housing section 142, the locking lugs 256 are confined to their inner position in which they are engaged in the external annular recess 260 formed in the outer surface of the valve body 228 to thus lock the shutter 253 on the valve body in seal covering position. The inside diameter 255 of the shutter is understandably equal to that of bore 148 of the upper body section 142 in which the upper seal means is sealingly engaged at all times and is likewise equal to bore 162 in which the lower seal means is housed when the valve is closed. Also, the inner wall of these bores, 148, 162 and 255, must be provided with a smooth finish suitable for these sliding o-ring seals.

Figure 6:
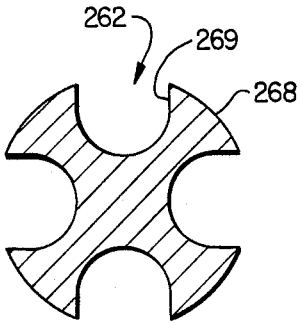
FIG. 6 is an enlarged cross-sectional view taken along line 6—6 of FIG. 5.
Figure 5:
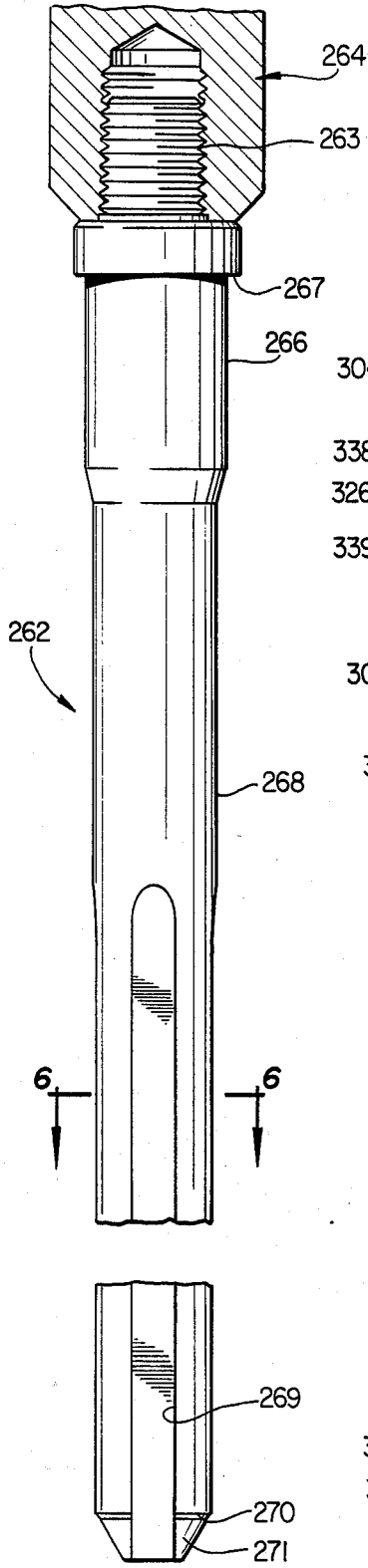
FIG. 5 is a longitudinal view, in elevation, showing the closing tool used for shifting the sliding valve of the test tool shown in FIGS. 2A, 2B, 2C, 3, and 4 to closed position.
Figure 7:
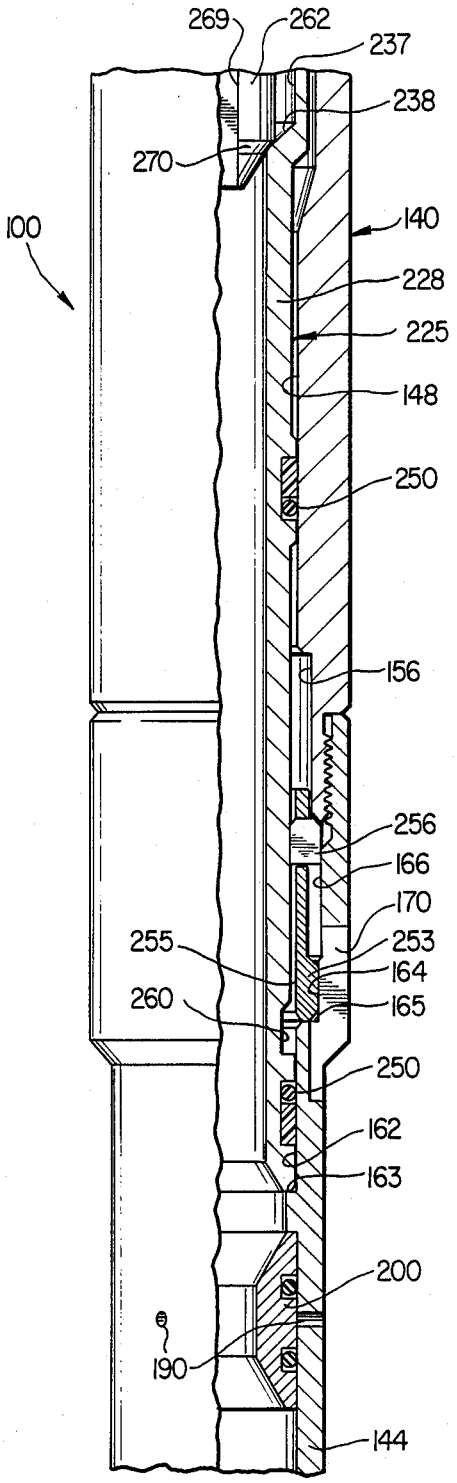
FIG. 7 is a fragmentary longitudinal view, partly in section and partly in elevation, showing the test tool of FIGS. 2A, 2B, 2C, 3 and 4 with its sliding valve closed and with its shutter locked in closed position.

When the valve body 228 is forced to its lower position, as seen in FIG. 7, as by a suitable shifting tool such as the down-shift tool 262, seen in FIG. 5, and having its lower portion formed as seen in FIG. 6, lowered into the well on a string of tools such as wireline tools on a flexible line, the lower, thickened portion of the shutter 253 moves through first enlarged bore 166 of the lower housing section 144, then through bore 164 and past the lateral flow port 170 to become abutted with seat 165. Thus, shutter 253 enters the carefully formed bore 164 where it is a fairly close fit and its carefully formed lower face 253*c* abuts the upwardly facing seat 165 with fairly intimate contact to virtually shut off any flow through the lateral flow ports 170. While the shutter 253 is thus seated on seat 165 and can move downward no further, continued downward movement of the valve body 228 carries the lower seal assembly 246, including seal ring 250, downward, out of the shutter bore 255, and into smooth bore 162 immediately below seat 165. Thus, the lower seal assembly is now sealingly engaged with the housing below the lateral flow ports while the upper seal assembly remains sealingly engaged within smooth bore 148, and all flow through the lateral flow ports is prevented. To aid in transferring the lower seal ring from shutter bore 255 above seat 165 into housing bore 162 below the seal, suitable chamfers are provided to prevent damage to the o-ring. The lower end of bore 255 of shutter 253 is flared as at 253*b* and bore portion 162 is flared at its upper end as at 162*a*.

As the sliding valve 225 moves downward and the locking lugs 256 move out of confining bore 156 and enter larger bore 166 of the lower housing section 144, and as the lower end 253C of shutter 253 contacts seat 165, the inclined wall which defines the upper limit of external annular lug recess 260 in the outer surface of the valve body will cam the locking lugs 256 to their outer position, seen in FIG. 7. Then, as the valve body continues downwardly to transfer the lower seal means into bore 162, the external recess 260 becomes positioned far below the locking lugs and the outer surface of the valve body will maintain the lugs in their outer position. No,, with the valve body in its lower position, the lugs are locked in their outer position wherein they are expanded immediately below enlarged bore 156 of the housing and cannot move up thereinto. This then, locks the shutter in its seated position as long as the lower seal means is below the seat 165. The just-described means for protecting the seal ring 250 as it is moved across the gap necessitated by the lateral flow ports 170 is similar to that disclosed in U.S. Pat. No. 4,453,599 incorporated herein by reference.

The down-shift tool 262 of FIGS. 5 and 6 has its upper end reduced in diameter and threaded as at 263 for attachment to tool string 264 while below the thread its diameter is reduced as at 266 to provide a conventional fishing neck 267. The down-shift tool 262 is further reduced in diameter as at 268 so that it may enter and pass through the central bore 232 of the locking device 102. Since considerable flow, and especially upward flow, may be taking place through the test tool at the time for shifting its valve closed, the down-shift tool is provided with a plurality of longitudinal round-bottom flutes, such as flutes 269, as shown, to provide a large capacity bypass and, thus, allow the down-shift tool to move down against such flow.

The lower end of the downshift tool 262 has a downwardly facing shoulder as at 270 and as tapered therebelow as at 271, and is small enough to pass upwardly facing shoulder 236, but is large enough to lodge against upwardly facing shoulder 238 at the lower end of recess 237 in the valve body 228. The shoulder 270 of the down-shift engages the upwardly facing shoulder 238 of the valve, while the tapered surface 271 serves the single function of guiding the tool on its downward travel in the well.

To reopen the test tool, the sliding valve 225 must be lifted from its lower, closed position, seen in FIG. 7, to its upper, open position, seen in FIGS. 2B–2C. This lifting of the valve is done by a suitable shifting tool such as the up-shift tool 300 seen in FIGS. 8A, 8B, 9, 10, 11A, and 11B.

The up shift tool 300, seen in FIGS. 8A, 8B 9, and 10, is shown to be attached to the lower end of a tool string indicated by the reference numeral 322, which may be the same tool string identified as tool string 264 seen in FIG. 5.

The up-shift tool 300 includes a housing means 301 comprising a housing member 302 and an upper sub 304. The housing member 302 having a bore 306 is internally threaded at its upper end as at 307 to receive the upper sub 304, while the bore 306 is reduced in inside diameter as at 308 to provide an upwardly facing shoulder 310 and further reduced as at 311 to provide an upwardly facing shoulder 312, as shown.

The upper sub 304 is reduced in outside diameter as at 314 near its upper end and further reduced in diameter as at 316 to provide downwardly facing shoulder 318 which is commonly called a fishing neck. A short distance above the fishing neck 318, the upper sub is reduced in diameter and threaded as at 320 for attachment of the tool string 322 by which the up-shift tool may be lowered into the well on a suitable flexible line such as flexible line 52.

Figure 8A:
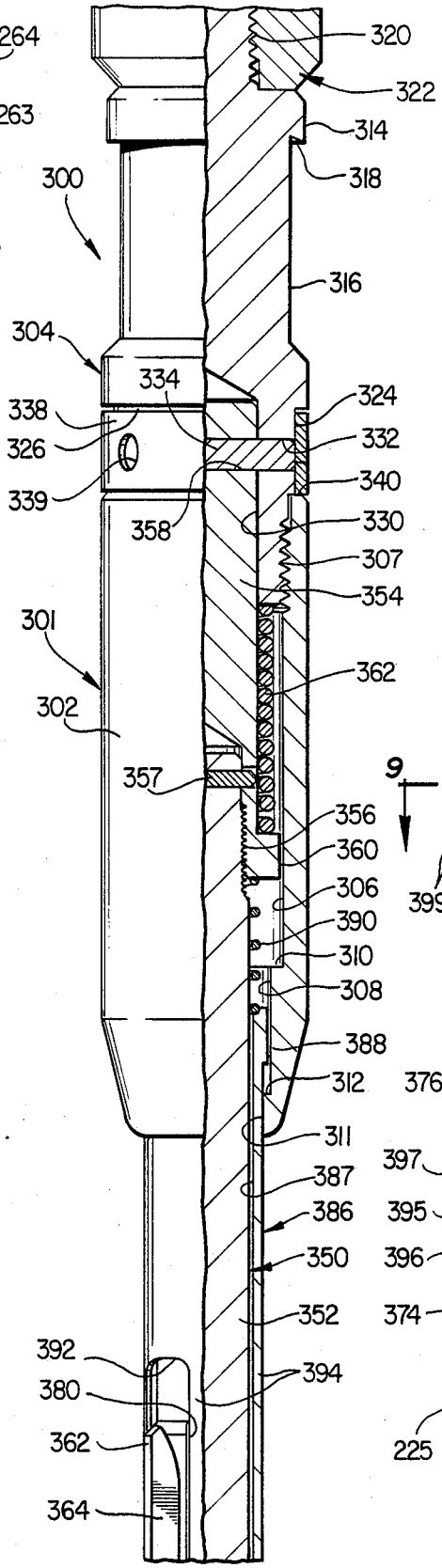
FIGS. 8A–8B, taken together, constitute a fragmentary longitudinal view, partly in section and partly in elevation, showing the opening tool of this invention releasably engaged in the sliding valve of the test tool of FIGS. 2A–4 and ready to lift it to its open position.

The upper sub 304 has its lower end portion reduced in diameter as at 324 to provide a downwardly facing shoulder 326, and is provided at its lower end with an external thread 307 by which the housing member 302 is attached thereto. The upper sub 304 has a blind bore 330 which opens downwardly as seen in FIG. 8A. Bore 330 of the upper sub is considerably smaller in diameter than bore 306 of the housing member for a purpose soon to become clear.

The upper sub 304 is cross-drilled a short distance below downwardly facing shoulder 326 to provide aligned apertures 332 on its opposite sides to receive shear pin 334, and a shear pin cover 338 surrounds the upper sub 304 to confine the shear pin and to prevent it from protruding from the up-shift tool as well as to prevent loss of the shear pin end fragments after the shear pin has been sheared. Shear pin cover 338 has opposite apertures 339 which may be aligned with holes 332 in the top sub to provide access thereto for inserting or removing the shear pin. This shear pin cover is confined between downwardly facing shoulder 324 and the upper end 340 of the housing member 302.

A mandrel assembly 350 comprises a mandrel member 352 and a mandrel extension 354 secured together by suitable means such as, for instance, thread 356. The mandrel assembly could, if desired, be formed in a single piece. The two-piece, threaded form may be desirable since the thread could provide means for adjusting the length of the mandrel member, if needed.

The threaded connection 356 is made secure by a pin 357 placed in aligned apertures in the mandrel member 302 and mandrel extension 354, as shown.

The mandrel extension 354 is releasably held fixed in the housing assembly by shear pin 334 which is disposed in aperture 358 with its opposite ends occupying the opposite apertures 332 in the upper sub 304.

An external annular flange 360 is formed on the lower end of the mandrel extension and a coil spring 362 surrounds the mandrel extension with its lower end bearing downwardly upon the upper side of external flange 360 and with its upper end bearing upwardly against the lower end of the upper sub 304. Thus, the spring 362 applies a downward bias to the mandrel assembly 350.

Figure 8B:
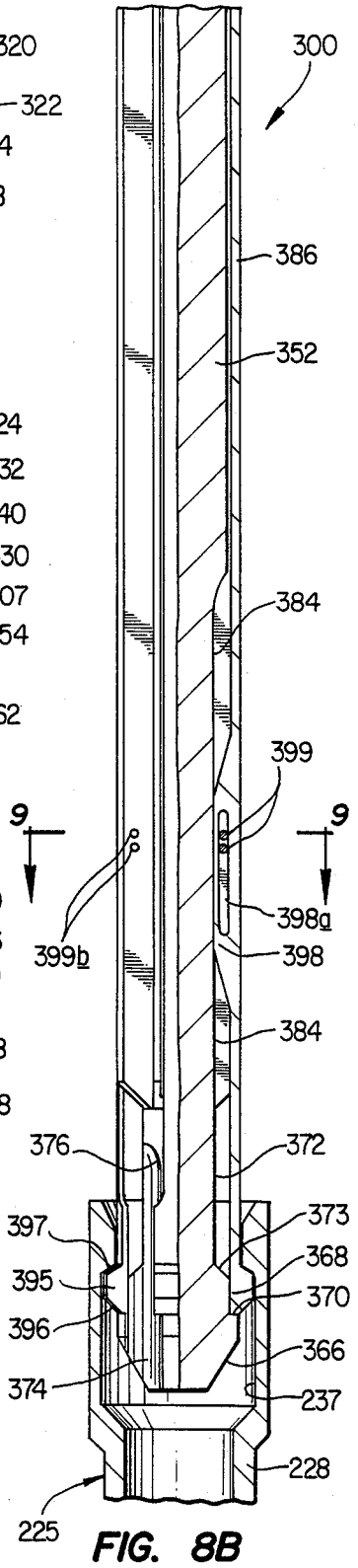

The mandrel member 352 extends from the lower end of the housing member bore, as shown in FIGS. 8A–8B. At a short distance below the housing member, the mandrel member is enlarged as at 362. The mandrel member is provided with a plurality of longitudinally extending bypass V-grooves such as grooves 364, the shape of which is better seen in FIGS. 9–10. Since four such grooves are formed in the exterior of the mandrel member, the same has a cruciform section in the grooved area.

The mandrel member 352 has a generous chamfer at its lower end providing an inclined guide surface 366 for guiding the lower end of the up-shift tool 300 into engagement with the test tool 100. Near its lower end, the mandrel member 352 is reduced in diameter as at 368 providing an upwardly facing support shoulder 370, as shown, and a short distance thereabove the mandrel member is reduced in diameter as at 372 providing an upwardly facing inclined cam surface 373 for a purpose to be explained later. Further, the lower portion of each of the longitudinal V-grooves 364 is further enlarged by a round-bottom groove 374 extending upwardly from the mandrel member's lower end and running out as at 376 as shown to greatly enhance the bypass capacity of the V-grooves. This increased bypass capacity is important when this opening tool is engaged in the close fitting bore of valve body 228 as shown in FIG. 8B.

Figure 9:
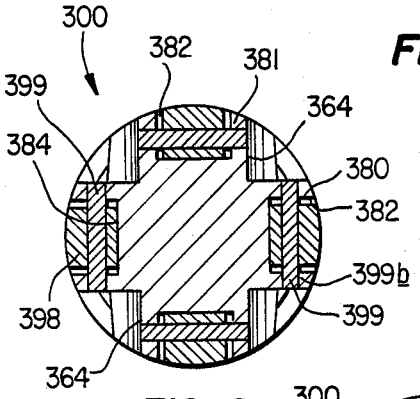
FIG. 9 is an enlarged cross-sectional view taken along line 9—9 of FIG. 8B.
Figure 10:
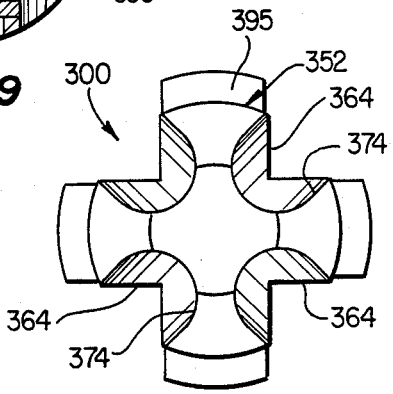
FIG. 10 is an enlarged view of the lower end of the up-shift tool shown in FIGS. 8A and 8B.

The four bypass grooves 364, as seen in FIG. 9, leave four ridges 380, each of which is provided with a flat bottom groove 382, as shown. In addition, each of the four flat-bottom grooves 382 is deepened in the area 384 which extends upwardly for a few inches from the reduced diameter portion 372 of the mandrel member.

A collet member 386 is tubular, having a bore 387, and is formed with an external flange 388 at its upper end. The collet member surrounds the mandrel member and is slidable longitudinally relative thereto, and has its flange 388 disposed in bore 308 in the housing member 302. A small spring 390, within the housing member, surrounds the mandrel member and has its upper end bearing upwardly against the lower end of mandrel extension 354 and with its lower end supported on the upper end of the collet member 386 to apply a downward bias thereto. If desired, the upper end of the collet bore 387 can be enlarged to provide a recess for the lower end of spring 390 as shown.

The collet member 386 is provided with four slots 392 at 90 degrees, thus providing four collet fingers 394. The upper portion of the collet member surrounds mandrel member 352 and the downwardly extending collet fingers 394, each occupy a flat-bottom groove 382 formed in each of the four ridges 380.

Each collet finger 394 is formed with an outwardly projecting boss 395 at its lower end having a downwardly facing inclined guide surface 396 and an upwardly facing inclined latch surface 397, as shown.

Figure 11A:
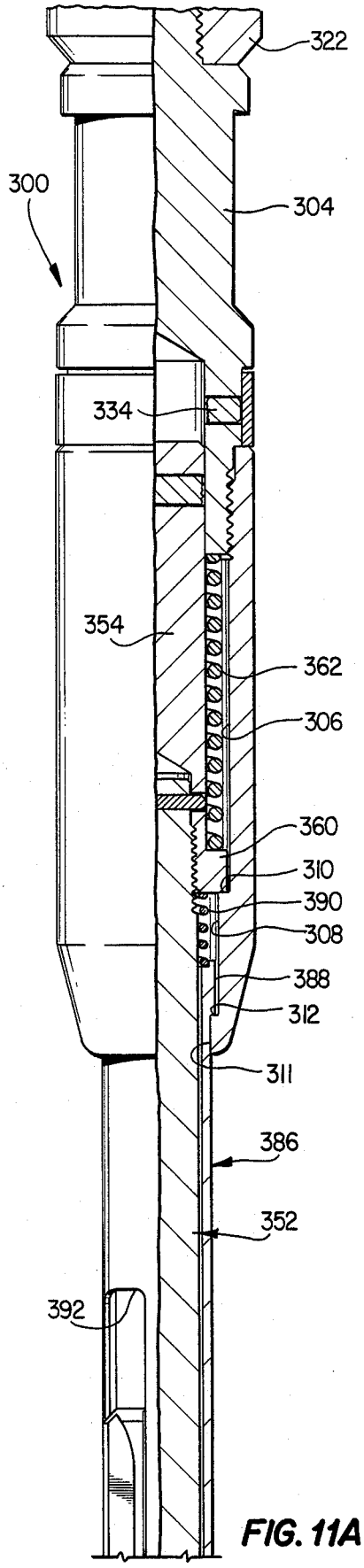
FIGS. 11A–11B, taken together, constitute a view similar to FIGS. 8A and 8B, but showing the opening tool of FIGS. 8A–8B in releasing position and ready to be disengaged from the sliding valve of the test tool.
Figure 11B:
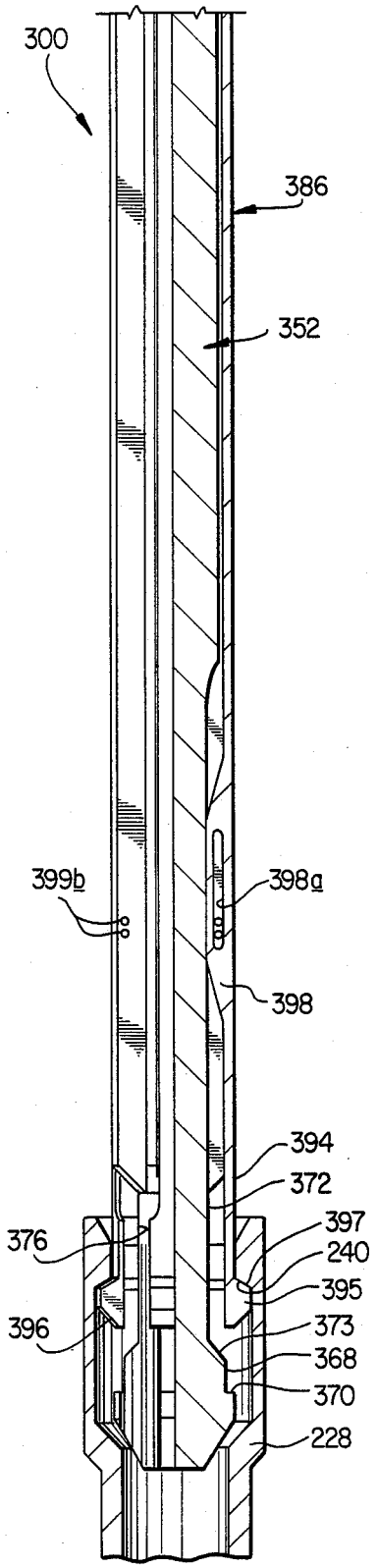

When the collet is in its lower position, shown in FIGS. 8A–8B, the lower ends of the collet fingers rest upon upwardly facing support shoulder 370 near the lower end of the mandrel means, and their bosses 395 extend outwardly beyond the periphery of the mandrel means, being backed up against inward movement by the reduced diameter portion 368 of the mandrel member. When the mandrel member moves down relative to the collet member, as when shear pin 334 becomes sheared as seen in FIGS. 11A–11B, the reduced diameter portion 368 and the cam surface 373 adjacent thereto are below the lower ends of the collet fingers and they may then be forced inwardly, as they would be when being released from their engagement with the valve body 228 of the test tool 100. Of course, during the engaging operation, as the lower end of the mandrel member enters the upper end of the valve 228, the lower end of the collet fingers contact the inclined guide surface 236 of the valve body but cannot enter the bore thereof since there is sufficient room only for the lower end of the mandrel member to enter. However, as the mandrel member continues downward, the collet member remains resting in contact with the upper end of the valve body. During this downward movement of the mandrel member and housing, the small spring 390 is compressed. After the cam surface 373 of the mandrel member begins to pass the lower end of the collet fingers, the downward force applied to the collet against the guide surface 236 (see FIG. 2B) in the upper end of the valve body will cause the lower end of the collet fingers to flex inwardly to allow them to enter and pass through the short tight portion of the valve body bore and enter the internal recess 237, at which time the collet will immediately be moved to its lowermost position by spring 390, seen in FIGS. 8A–8B. The up-shift tool is now engaged with the valve body and if it is lifted, the upwardly facing latch shoulders 397 of the collet fingers will engage the corresponding downwardly facing latch shoulder 240 at the upper end of internal recess 237 of the valve body, as clearly seen in FIG. 8B.

The collet fingers 386 are understandably long, narrow and thin. Accordingly, they are readily flexed. To confine them against flexing outwardly and getting out of their respective flat-bottom grooves, each collet finger 386 is preferably formed with an elongate internal boss 398 formed as shown in FIGS. 8B, 9 and 11B, and with an elongate slot **398*a* through which a pair of spaced-apart pins 399 extend, their opposite ends being received in aligned apertures 399*b* formed in the sides of the flat-bottom grooves, as shown. The internal boss 398 is slidable in the deepened portion 384 of the flat-bottom grooves 382. The slots 398*a* permit up-and-down movement of the collet fingers relative to mandrel member 352 while the pair of pins 399** maintain their alignment within proper range.

When the up-shift tool 300 is latched into the sliding valve 225 of the test tool 100 as seen in FIGS. 8A–8B, lifting of the up-shift tool will also lift the sliding valve. Of course, if a straight upward pull proves inadequate for this operation, upward jarring impacts may be required. Such jarring is well known and commonplace, especially in the such as bottom hole pressure gages, for instance, are delicate and easily damaged by jarring, and are very expensive too. Therefore, they should be protected by suitable shock absorber devices for insulating them from potentially damaging shock forces even though most of the impact forces are transmitted harmlessly to the well tubing. In addition, they should be handled, transported, run into the well, and pulled therefrom very carefully so as to avoid undue shocks and damage. Clearly, every precaution should be taken.

When the sliding valve 225 arrives at its uppermost position, as seen in FIGS. 2B–2C, the up-shift tool has completed its work and must be disengaged from the sliding valve 225.

To disengage the up-shift tool 300 from latching engagement in the internal recess 237 of the valve body 228, upward jarring impacts are applied to the up-shift tool through manipulation of the flexible line 52 and tool string 322. Such upward impacts apply an upward force to the upper sub 304 attached to the tool string 322 tending to lift it, but mandrel assembly which is pinned by shear pin 334 to the upper sub, is firmly latched into the valve body 228 by engagement of the collet finger bosses 395 in recess 237 of the valve body. This tendency to force the upper sub 304 upward relative to the mandrel assembly will, after several carefully applied upward impacts, cause the shear pin 334 to fail, thus permitting large spring 362 to expand and force the mandrel assembly downward relative to the upper sub 304 and housing member 302. Of course, at first, the housing moves upward until upwardly facing shoulder 312 in the housing member engages the lower side of external flange 388 at the upper end of the collet 386. By this time, the shear pin 334 is fully sheared. It should be understood, that the space between the lower side of the collet flange 388 and the upwardly facing shoulder 312, as shown in FIG. 8A, is provided to permit shearing of the shear pin 334 without such upward forces being applied to the rather fragile collet fingers. Once the shear pin 334 fails, the spring 362 will immediately force the mandrel assembly and the collet downward, relative to the housing member. The collet soon stops by its engagement of its flange 388 with upwardly facing shoulder 312 in the housing member, but the mandrel assembly continues to move downward until the external flange 360 of the mandrel extension 354 comes to rest upon upwardly facing shoulder 310 of the housing member, as seen in FIG. 11A. This is the lowermost position of the mandrel member, and in this position, the lower ends of the collet finger are clearly on a level with the mandrel member's external recess 372, as seen in FIG. 11B. The up-shift tool 300 may, at this time, be lifted free of the test tool, the lower ends of the collet fingers flexing inwardly as permitted by the mandrel recess 372 and due to the inward camming forces resulting from the cam action of the upward inclined shoulder 397 on the collet finger boss 395 coacting with the corresponding downwardly facing shoulder 240 at the upper end of internal recess 237 of the valve body 228. Thus, the up-shift tool will be readily pulled free of the test tool and may be retrieved from the well.

When it is desired to remove the test tool 100 from the well and the test tool happens to have its sliding valve in the open position, a suitable retrieving tool is lowered into the well on a flexible line to engage the test tool, release the lock device 102 and retrieve the test tool. It is imperative that the retrieving tool be compatible with the lock device used. In FIGS. 2A–2C the test tool assembly 100 is shown to include a locking device well-known in the industry as the Otis Type X Locking Mandrel. The retrieving tool recommended for retrieving this lock device is the Otis Type GS Pulling Tool which releases in response to downward jarring impacts.

If, however, the valve of the test tool to be retrieved is in the closed position, it is not necessary to first run the up-shift tool 300 and afterwards run the retrieving tool to retrieve the test tool. It is only necessary to add an equalizing prong to the retrieving tool. Then, when the retrieving tool engages the test tool, careful downward jarring impacts are utilized to force the equalizing valve closure 200 (FIG. 2C) down to uncover the equalizing ports 190 so that equalization of pressures above and below the test tool may take place, after which the lock device may be released and the test tool retrieved.

Figure 13:
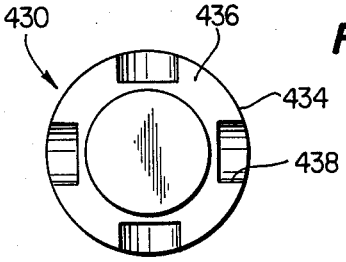
FIG. 13 an enlarged bottom view of the equalizing prong of FIG. 12.
Figure 12:
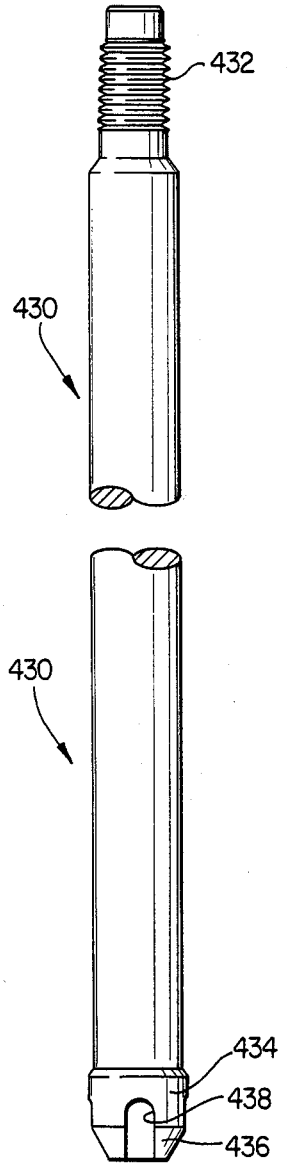
FIG. 12 is a longitudinal view, in elevation, showing the equalizing prong used for shifting the equalizing valve of the test tool of FIGS. 2A, 2B, 2C, 3, and 4 from close to open position.

Referring to FIG. 12, it is seen that a suitable equalizing prong is illustrated and is indicated generally by the reference numeral 430. The equalizing prong has its outside diameter reduced at its upper end and threaded as at 432 for attachment to a suitable retrieving tool. Near its lower end, the equalizing prong is enlarged as at 434 and this enlargement is chamfered at its lower end to provide a downward tapered guide surface 436. At least one and preferably a plurality of slots 438 are formed in the prong's outer surface, and these slots begin at the lower end of the prong and extend well beyond the upper extent of the guide surface 436. See also FIG. 13 which presents a bottom view of the equalizing prong 430. The guide surface 436 guides the prong past shoulders and obstructions in the well and into the test tool. The equalizing prong comes to rest with the guide surface 436 in contact with the funnel-like flared upper end of bore 234 of the equalizing valve closure 200. The slots 438 of the equalizing prong provide ample flow passage for well fluids so that when downward jarring impacts are delivered to the equalizing closure 200 through the equalizing prong 430 to drive it down and uncover the equalizing ports 190, the prong will not make sealing contact with the equalizing valve and hinder the equalizing and retrieval operations.

Test tool 104 of FIGS. 2B–2C has been described herein-above principally with respect to production well testing where fluids, during the production phase, flow from the earth formation into the well and then through the well tubing to the surface. Although test tool 104 can be used in injection well testing in which fluids are injected from the surface through the well into the formation, such test can be performed with a simpler, shorter, and less costly test tool. Such test tool is illustrated in FIGS. 14 and 15.

Figure 14:
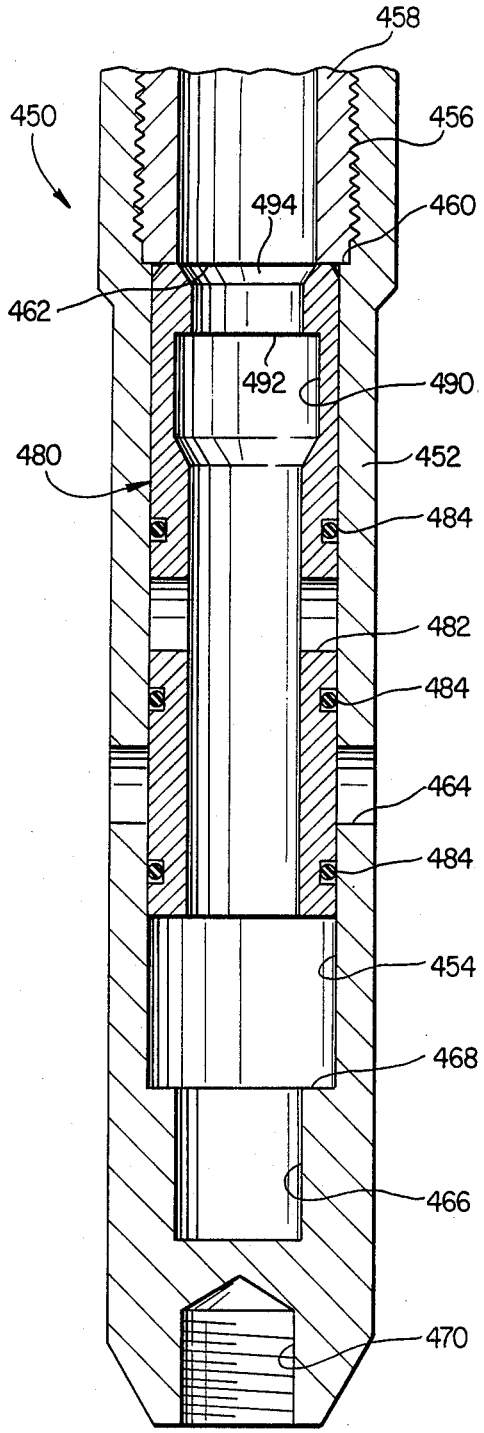
FIG. 14 is a fragmentary schematical view showing a modified form of the invention with its valve in its upper closed position.
Figure 15:
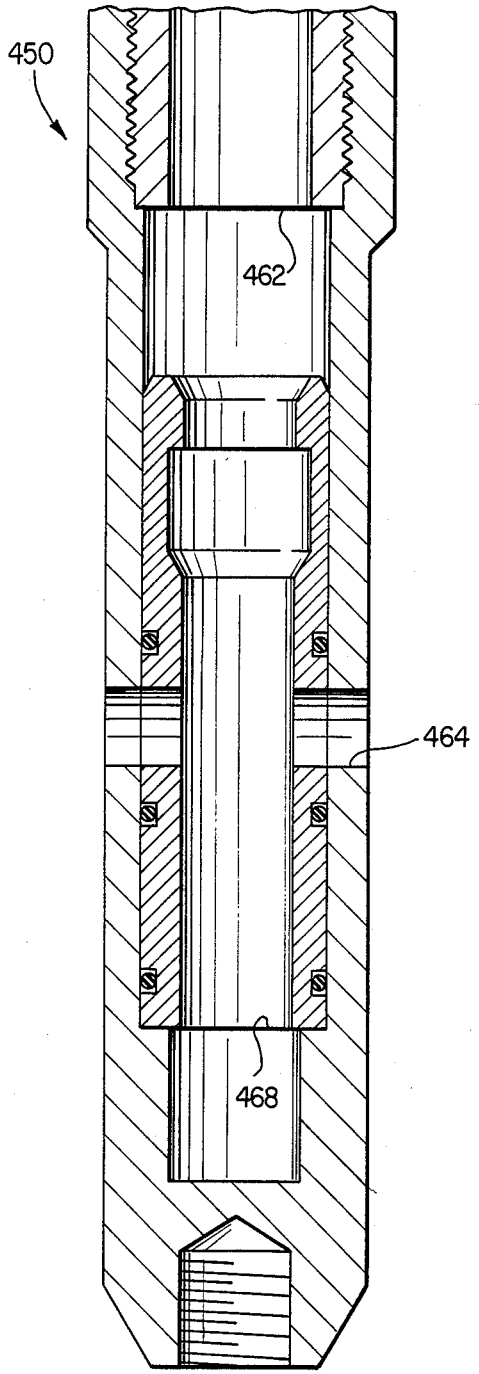
FIG. 15 is a view similar to FIG. 14 showing the test tool of FIG. 14 with its valve in its lower open position.

Referring now to FIGS. 14 and 15, a well test tool for carrying out injectivity tests of earth formations is illustrated schematically and indicated generally by the reference numeral 450.

Test tool 450, as shown, includes a housing 452 having an upwardly opening blind bore 454 which is enlarged and threaded as at 456 for attachment to suitable lock device 458, and providing an upwardly facing shoulder 460 against which the lower end 462 of the lock device is tightened. Housing 452 is provided with lateral flow ports 464 for communicating the interior of the housing with its exterior. Further, the housing bore 454 is reduced in size as at 466 providing an upwardly facing stop shoulder 468. Bore 466 is closed at its lower end, as shown. The lower end of the housing 452 is provided with a thread as at 470 for attachment of a recording instrument if desired. Such recording instrument (not shown) may include sensor means responsive to well conditions such as, for instance, pressure and/or temperature, or the like, and which may be like instrument 106 of FIG. 2C. Bore 466 provides a chamber or sand trap for collecting sand or other solids which may drift down from above.

A sliding valve 480 having lateral ports 482 and carrying three spaced-apart seals, such as seal rings 484, is disposed in bore 454 of the housing for sliding movement therein between an upper, closed position, shown in FIG. 14, and a lower, open position, shown in FIG. 15. Movement of the valve 480 is limited at the upper end of its travel by engagement with the lower end 462 of the lock device (see FIG. 14) and at the lower end of its travel by engagement with stop shoulder 468.

When the valve is in its upper, closed position, the two lower seal rings seal one above and one below the lateral flow ports of the housing, the seals being sealingly engaged between the housing and the valve. No flow can take place through the test tool when the valve is closed, as shown in FIG. 14.

When the valve is in its lower, open position, seen in FIG. 15, the lateral ports 482 of the valve are aligned with the lateral flow ports 464 of the housing and flow is permitted to take place through the test tool.

The valve 480 is provided with an internal recess 490 providing a downwardly facing shoulder 492 which is engageable by a suitable up-shift tool for moving the valve to its upper position. The valve is also provided with an upwardly facing internal shoulder 494 which may be engaged by a suitable down-shift tool for moving the valve to its lower position.

It may now be clearly seen that whereas the test tool 104 previously described was structured so that its sliding valve 225 was shifted to its upper position to open the flow ports of the housing for flow therethrough while the test tool 450 of FIGS. 14 and 15 is structured oppositely in that its valve 480 must be moved downward to its open position. Thus, the term "up-to-open" may be applied to test tool 104 and, similarly, the term "down-to-open" may be applied to the test tool 450.

When the test tool 450 is open as seen in FIG. 15, fluids may be down the tubing, through the test tool, and outward through its ports 464 and into the formation surrounding the well. Well conditions are sensed and recorded continuously by the instrument (not shown) during such injection period. The valve may then be closed, as by shifting it to its upper position, and is left closed for a period while the well conditions continue to be recorded. The valve may be cycled between open and closed positions as often and as many times as desired in order to perform the injectivity tests which may be prescribed.

Figure 16:
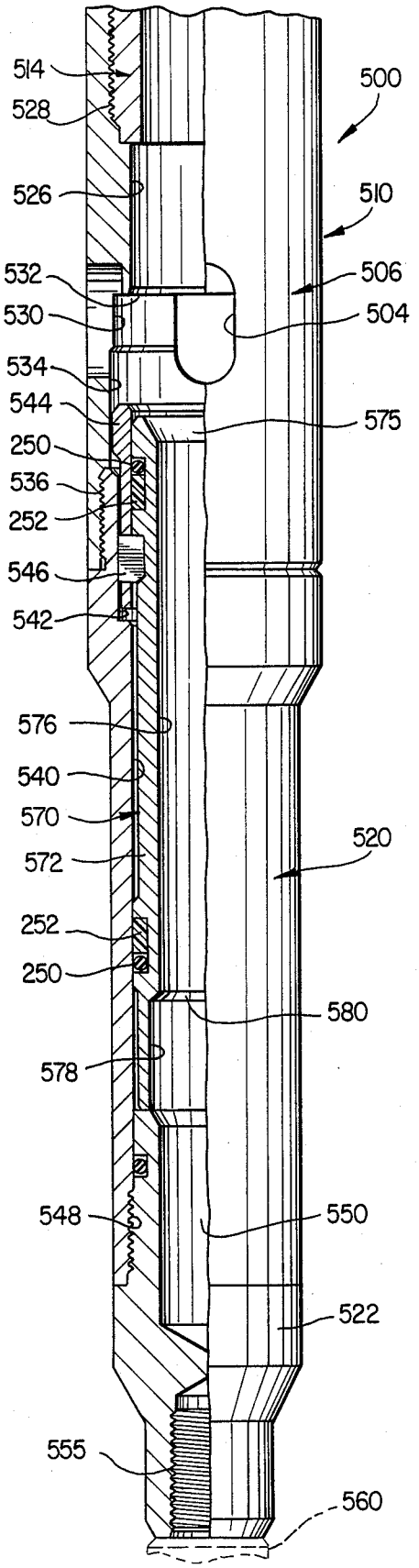
FIG. 16 is a fragmentary longitudinal view, partly in section and partly in elevation, showing a modified form of the invention similar to that seen in FIGS. 14 and 15 but having a shutter mechanism like that seen in FIGS. 2C and 7, the valve being open.
Figure 17:
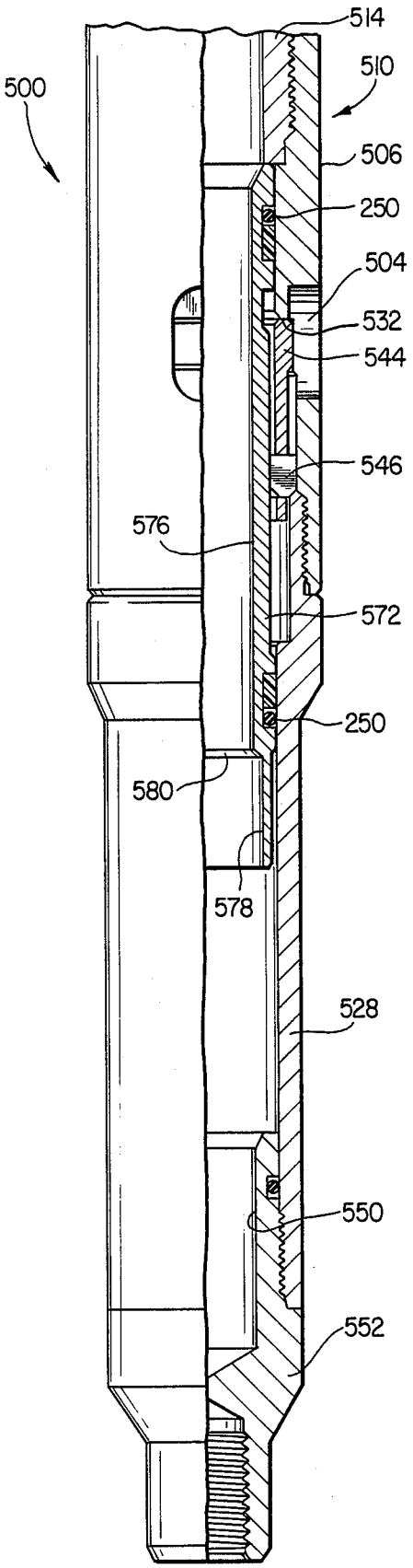
FIG. 17 is a view similar to FIG. 16, but showing the valve in closed position.

In FIGS. 16 and 17 a more practical structure of a down-to-open test tool is shown and is indicated generally by the reference numeral 500. Test tool 500 is particularly suited for use in carrying out injectivity tests.

Test tool 500 is very similar in structure to the test tool 104 of FIGS. 2A–4, and 7, but differs principally in that the sliding valve mechanism of test tool 500 is shorter and is inverted to cause it to open downwardly, and it has no equalizing valve. In addition, the housing member of test tool 500 is considerably shortened, and the lateral flow ports have been relocated to a much higher location. In fact, whereas the lateral flow ports 170 of test tool 104 are located in the lower housing section 144, the test tool 500 has its lateral flow ports 504 located in the upper housing section 506 of the housing assembly 510.

In FIGS. 16 and 17, the test tool 500 is shown attached to the lower end of a suitable lock device 514 which may be exactly like the lock device 102 of FIGS. 2A–2B.

Housing assembly 510 includes upper housing section 506, lower housing section 520, and lower sub 522.

Upper housing section 506 has a bore 526 enlarged and threaded as at 528 for attachment of the lock device 514, as shown. Bore 526 is also enlarged as at 530 to provide downwardly facing annular seat surface 532, and is further enlarged as at 534 and threaded as at 536 for attachment of the bottom sub 522. Upper housing section 506 is provided with lateral flow ports 504 located adjacent the annular seat surface 532, as shown.

The lower housing section 520 has a bore 540 which is enlarged at 542 to provide room for the shutter 544 and latching lugs 546. The upper end of the lower housing section 520 is reduced in outside diameter and externally threaded as at 536 for attachment to the upper housing section. The lower housing section has the lower end of its bore 540 internally threaded as at 548 for attachment of lower sub 522.

The lower sub 522 may be interchangeable with the lower sub 146 of the first embodiment, and it serves exactly the same function, that of closing the lower end of the housing assembly 510, of providing a container as at 550 for collecting sand or other solid particles drifting down from above, and of providing a connection such as threaded connection 555 for attachment of a suitable recording instrument 560, or, in the absence of an instrument, of a protector such as protector 186, seen in FIG. 2C.

A sliding valve 570 is disposed within the housing assembly 510 and serves the same function as did the sliding valve 225 of the test tool 104 previously described, being slidable between an open position wherein it does not cover the lateral flow ports 504 of the housing and a closed position wherein it covers the lateral flow ports 504 of the housing.

Sliding valve 570 includes a valve body 572 having a resilient seal such as the o-ring 250 near each of its ends and a suitable back-up ring such as the back-up ring 252 adjacent thereto. The back-up ring in this case, however, is on the opposite side from those in the first embodiment, the upper back-up ring being below the upper o-ring, and the lower back-up ring being above the lower o-ring, as seen in FIGS. 16 and 17. Such arrangement is recommended in cases where the test tool 500 is to be used for injectivity tests, particularly in cases where high pressure differentials will be encountered.

The valve body 572 carries a shutter mechanism including a shutter sleeve 544 and lock lugs 546 which function exactly as did the shutter 253 and lugs 256 in the previous embodiment, thus serving to engage the annular seat surface 532, pinch the fluid flow through the lateral flow ports 504 and make it possible to slide the o-ring from within the shutter sleeve and into sealing engagement in bore 526 of the housing as seen in FIG. 17 without damaging the o-ring.

The valve housing is shiftable from its upper, closed position, seen in FIG. 17, to its lower open position, seen in FIG. 16, through use of a suitable down-shift tool such as the down-shift tool 262 of FIG. 5, previously described but could be of shorter length. This is because the upper end of the valve body 572 when in the open position is only a short distance below the lower end of the lock device 514, the down-shift tool having its lower end engaged with upwardly facing shoulder 575 at the upper end of the valve body.

The valve body 572 is formed with its bore 576 counter-bored as at 578 to provide downwardly facing shoulder 580 to be engaged by a suitable up-shift tool for forcing the valve body from its lower to its upper position in the housing. A suitable up-shift tool could be much like the up-shift tool 300 previously described, but with a slightly longer reach since the shoulder 580 to be engaged in the valve body is at the lower end thereof rather than near the upper end of the valve body thereof as in the first embodiment.

It is understood that whether the valve member 572 of test tool 500 is in its open or closed position, no flow takes place through its bore 56. It is readily seen that a tool sufficiently small to pass through bore 576 of the valve body 572 would have plenty of clearance in housing bore 526 and the bore of lock device 514. Therefore, such shifting tools may need only minimal bypass grooves formed therein.

Figure 18:
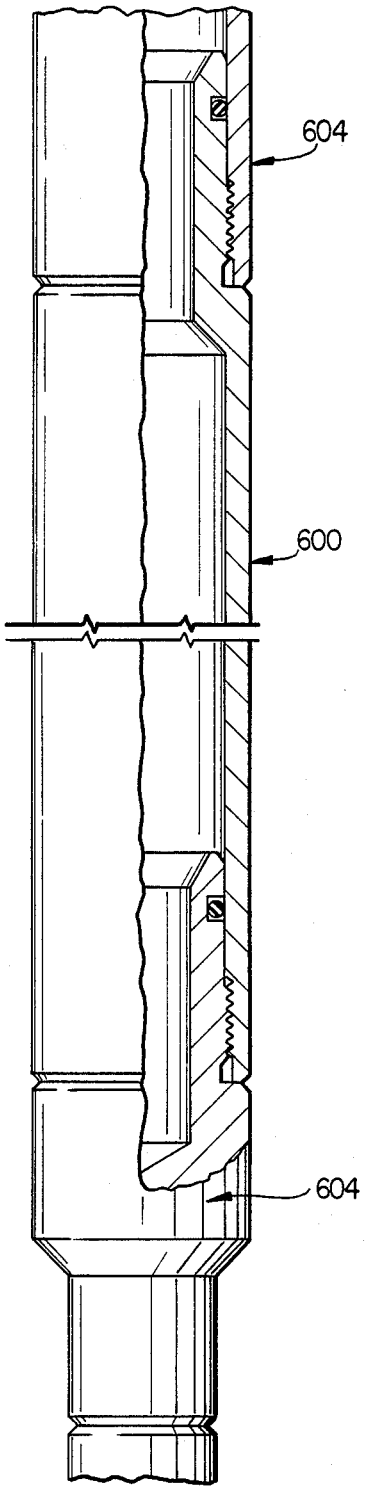
FIG. 18 is a fragmentary longitudinal view, partly in elevation and partly in section with some parts broken away, showing a sand trap module connected into the test tool of this invention.

Provision was made in the first embodiment 104 and in the second embodiment 500 of the test tool for collecting sand or similar solids which might drift down from above. This collection region was provided by an upwardly opening blind bore in the lower subs 146 and 522, respectively. If large amounts of such solids are expected to be collected, one or more modules such as module 600 can be installed between the lower housing section 602 and the bottom sub 604 as seen in FIG. 18.

In some cases it may be desirable to not have the recording instrument, say a recording bottom hole pressure gage, attached to the lower end of the test tool and supported thereby. For instance, it may be needful to have the instrument at or very near the casing perforations or the lower end of the tubing but the lowermost landing receptacle in the well for receiving the test tool may be some distance above the lower end of the tubing. The solution to this problem is illustrated in FIG. 19.

Figure 19:
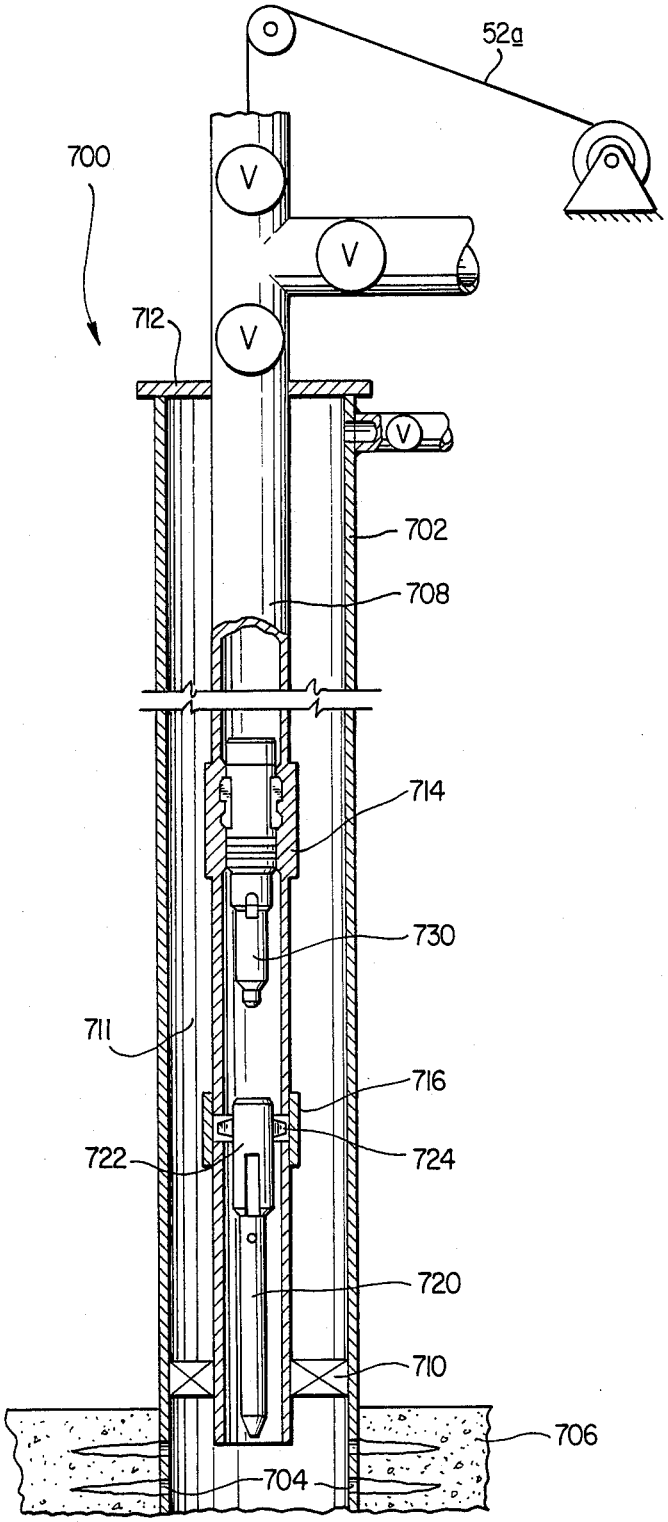
FIG. 19 is a schematical vie similar to FIG. 1, but showing the recording instrument suspended in the well tubing, below and independently of the test tool of this invention.

In FIG. 19, a well 700 has its casing 702 perforated at 704 opposite formation 706 and a well tubing 708 is disposed in the casing and has a packer 710 sealing the lower end of the annulus 711. A wellhead 712 closes the upper end of the annulus. The well tubing has a landing receptacle 714 some distance, perhaps several hundred feet, above the lower end of the tubing. That portion of the well tubing below the landing receptacle 714 contains at least one coupling such as coupling 716 providing a space between the adjacent joints of tubing. This space is commonly known as a coupling recess. In the case of well 700 of FIG. 19, the coupling recess in coupling 716 is utilized to support the instrument 720. Thus, it is seen that the instrument 720 is attached to the lower end of a suitable hanger such as hanger 722 having latch members 724 which are expanded outwardly into such coupling recess.

Instead of supporting the instrument from the recess in coupling 714, it could as well be supported from another landing nipple, or from a selected one of several types of hangers which can be set just about anywhere in the tubing. Suitable hangers for hanging recording pressure gages, or the like instruments, from the tubing, or a coupling recess, or a landing receptacle are available from Otis Engineering Corporation, Dallas, Texas.

In FIG. 19, the recording instrument 700 is shown to have its lower end virtually at the level of the casing perforations 704. The test tool 730 is shown to be supported from a lock device, such as the Otis Type X Locking Mandrel, anchored and sealed in the landing receptacle 714 which in such case would be an Otis Type X Landing Nipple.

Thus, the test tool 730 may be supported in the tubing at a location somewhat above the formation to be tested, and the recording instrument 720 may be supported in the tubing a distance below and independently of the test tool. The test tool 730 and the recording instrument can be installed and removed through use of the flexible line **52*a*** and suitable flexible line tools (not shown) as before explained.

The test tool 730 may be of the up-to-open type or the down-to-open type, and the well 700 can be a producing well, or an injection well. In either case, the test tool 730 will be shifted between open and closed positions to control flow therethrough by suitable shifting tools such as up-shift and down-shift tools lowered into the well on the flexible line 735 while the recording instrument continuously records changes in the well characteristics at or near the level of the perforation 704 during both the flow and the shut-in periods.

It is now readily understandable that in each of the test tools disclosed hereinabove, both the flow phase and the shut-in phase of the formation testing operation can be carried out without need of the flexible line in the well. This is a real advantage since the essential wire line is exposed to corrosive well fluids for only a short time. Otherwise, the wire line could be corroded or otherwise weakened. Corroded wire line is often difficult to fish from a well. However, in order to shift the test tool to either open or closed position, it is necessary to run one of the shifting tools into the well on the flexible line. But, as soon as the valve has been shifted, the flexible line may be immediately pulled from the well. This is a very desirable advantage since either phase of the test may last for many hours or days and the expensive flexible line equipment may be removed from the well and made available for other jobs. In this manner, a single flexible line set-up and crew could carry on simultaneous testing operations on several wells through use of test tools embodying this invention. Also, the fact that the flexible line need not be left in the well during each phase of the testing operation is an advantage in the case of offshore wells, or wells located on or under water. The water surrounding such wells is subject not only to wave action but also to the tides, either of which can cause line breakage and fishing jobs, as well as other unwanted and costly mishaps, and such conditions can be made much more severe by bad weather which can develop quickly.

Further, it is now readily understood that the test tools and systems disclosed hereinabove make it possible to carry out novel methods of testing wells.

One method of this invention involves attaching a recording instrument to the lower end of a test tool assembly constructed in accordance with the present invention, attaching the test tool assembly to a string of flexible line tools, lowering the test tool assembly into a well and installing it in a landing receptacle leaving the test tool open, withdrawing the flexible line and tool string to the surface, allowing flow to take place through the test tool assembly for a period of time, lowering a shifting tool into the well on the tool string and shifting the test tool to closed position and withdrawing the flexible line and tool string to the surface, leaving the test tool closed for a period of time to allow well pressure to stabilize therebelow, continuously sensing and recording well characteristics with the recording instrument during both the flowing and shut-in periods, and lowering a retrieving tool into the well on the tool string and retrieving the test tool assembly.

Similar methods of this invention include cycling the test tool any desired number of times, it being unnecessary to have the flexible line and tools in the well during either the flowing or the shut-in phase of the well tests. the test tool can be the type disclosed herein called up-to-open or the type called down-to-open. The recording instrument may be attached to and supported from the test tool or it can be attached to and supported from a hanger installed at a location below and independent of the test tool during a separate run of the flexible line and tool string into the well. The hanger for the instrument can be engaged in a landing receptacle, a coupling recess, or anywhere along the tubing. If either of the flowing or shut-in phases of the well testing operation is to be for an extended period of time, the flexible line equipment can be completely removed from the well and made available for use elsewhere. The test tools can be used in performing methods of testing producing wells or injection wells. Further, the well testing methods of this invention may include also the step of equalizing pressures above and below the test tool preparatory to withdrawing the test tool from the well.

The foregoing description and drawings of the invention are explanatory and illustrative only, and various changes in sizes, shapes, and arrangement of parts, as well as certain details of the illustrated construction, or similar changes in the systems or methods, may be made within the scope of the appended claims without departing from the true spirit of the invention.

I claim:

1. A well test tool, comprising:

(a) a body housing means having:

(i) a longitudinal bore open at its upper end and closed at its lower end, (ii) lateral flow port means through its wall communicating said bore with the exterior of said housing means, (iii) connection means at its upper end for attachment of a locking device for anchoring the test tool in a well, and (iv) connection means at its lower end for attachment of an instrument for sensing and recording conditions in the well;

(b) sleeve valve means in said bore of said housing means slidable up and down between positions opening and closing said lateral flow port means for controlling fluid flow therethrough; and (c) seal means sealing between said housing means and said sleeve valve means above and below said lateral flow port means when said sleeve valve is in closed position, said seal means sealing equal areas, (d) means on said sleeve valve means engageable by shifting tool means lowerable into the well on a flexible line for shifting said sleeve valve means up or down, said flexible line being disconnectable and removable from said well after said sleeve valve has been shifted from either position to the other position with the test tool remaining in the well.

2. The test tool of claim 1, wherein said seal means is a pair of resilient o-rings.

3. The test tool of claim 1, wherein said housing includes a chamber below said sleeve valve means for collecting sand or other solid particles which may settle from above.

4. The test tool of claim 1 in combination with a lock device attachable to the upper end thereof for landing the test tool in locked and sealed relation in a landing receptacle in a well.

5. The test tool of claim 1 in combination with a locking device attachable to the upper end thereof and a landing receptacle for receiving said locking device in locked and sealed relation therein, said landing receptacle having connecting means thereon for attachment in a well tubing as a part thereof.

6. The test tool of claim 1, wherein said sleeve valve means is formed with an internal downwardly facing shoulder, in combination with an up-shift tool lowerable into the well tubing on a flexible line said up-shift tool having latch means for releasably engaging said downwardly facing shoulder of said sleeve valve means for lifting said sleeve valve means from its lower position to its upper position by means of the flexible line, said up-shift tool including a shear pin which is shearable by upward jarring impacts for releasing said latch means from said sleeve valve means, permitting withdrawal of said up-shift tool, after said sleeve valve has been shifted to its upper position.

7. The test tool of claim 1, 2, 3, 4, 5 or 6, wherein said lateral flow port flow of said housing means is open to allow flow therethrough when said sleeve valve means is in its lower position.

8. The test tool of claim 7, wherein a recording instrument including sensor means is attached to the lower end of said test tool for continuously recording well characteristics while said test tool is in the well.

9. The test tool of claim 1 wherein said housing means is provided with a lateral equalizing passage through its wall a spaced distance below said sleeve valve means and an equalizing valve member having a pair of spaced-apart seal rings normally sealing above and below said lateral equalizing passage, said equalizing valve member being shiftable downwardly to an open position uncovering said equalizing port to permit equalization of pressures above and below said closed test tool to take place through said equalizing passage.

10. The test tool of claim 1, 2, 3, 4, 5, 6, or 9, wherein a recording instrument including sensor means is attached to the lower end of said test tool for recording well characteristics while said test tool is installed in the well.

11. The test tool of claim 1, 2, 3, 4, 5, 6 or 9, wherein said lateral flow port of said housing means is open to allow flow therethrough when said sleeve valve means is in its upper position.

12. The test tool of claim 11, wherein a recording instrument including sensor means is attached to the lower end of said test tool for continuously recording well characteristics while said test tool is in the well.

13. A system for testing an earth formation penetrated by a well bore, said system including:

(a) a well tubing string including a landing receptacle constituting a longitudinal section thereof;

(b) a test tool receivable in said landing receptacle in locked and sealed relation therewith, said test tool including:

(i) housing means having a blind bore therein opening upwardly and closed at its lower end, said housing means having a lateral flow port through its wall, (ii) a sleeve valve in said housing shiftable longitudinally up and down to open and close said lateral flow port of said housing to permit or prevent fluid flow through said test tool, said sleeve valve having means thereon engageable by a shifting tool lowered into the tubing on a flexible line after said test tool has been installed in said landing receptacle for shifting said sleeve valve as desired, from either of its positions to the other of its positions a plurality of times, said flexible line being disconnectable from said test tool and removable from said well after shifting the valve opened or closed a plurality of times before removing the test tool from the well; and (c) characteristic measuring and recording means below said test tool and associated therewith for continuously measuring and recording well characteristics at said test tool while it is installed in the well.

14. The system of claim 13, wherein said sleeve valve is shifted by an up-shift tool, lowered into the well tubing on a flexible line from its lower to its upper position said up-shift tool having latch means which latchingly engage the sleeve valve and lift it to its upper position, after which it then is released therefrom for removal of the up-shift tool and the flexible line from the well.

15. The system of claim 14, wherein said housing of said test tool is further provided with an equalizing port and by an equalizing valve initially closing the same, said equalizing valve being shiftable to port opening position to allow pressures to equalize across the test tool prior to releasing said test tool from said landing receptacle for retrieval from the well.

16. The system of claim 15, wherein said test tool includes a chamber below said equalizing valve for receiving sand or other solid particles gravitating down from above.

17. The system of claim 13, 14, 15, or 16, wherein said characteristic measuring and recording means is attached to said test tool.

18. The method of testing a well having a casing therein perforated opposite an earth formation to be tested, and a well tubing inside said casing, the well tubing including a landing receptacle and having a well packer sealing between the tubing and the casing above the perforations, said method comprising the steps of:

(a) running a test tool into the well tubing on a flexible line and installing it in said landing receptacle in locked and sealed relation therewith, said test tool being open, and withdrawing said flexible line from said well tubing, said test tool having associated therewith a device for measuring and recording well characteristics below said test tool;

(b) allowing flow through said open test tool for a period of time, then lowering a shifting tool into the well tubing on a flexible line and closing said test tool, and withdrawing the flexible line and shifting tool from the well tubing;

(c) allowing said test tool to remain closed for a period of time;

(d) measuring and recording well characteristics during periods both when the well is shut in and when the well if flowing;

(e) lowering another shifting tool into the well tubing on the flexible line and opening the test tool, then withdrawing the flexible line and shifting tool from the well tubing;

(f) repeating steps b, c, and d as necessary; and (g) lowering a retrieving tool into said well tubing on a flexible line and releasing said test tool from said landing receptacle and retrieving it from said well tubing.

19. The method of claim 18, including the additional step of equalizing pressures across said test tool prior to releasing the test tool from the landing receptacle for retrieval from the well tubing.

20. The method of claim 18, or 19, wherein said measuring and recording means is carried by said well test tool.

21. The method of claim 20 wherein said flow through said test tool takes place in a direction from said formation through said well tubing to the surface.

22. The method of claim 20, wherein said flow through said test tool takes place in a direction from the surface, through said well tubing to said formation.

23. The method of claim 18, or 19, including the additional step of: supporting said measuring and recording device in said well tubing a spaced distance below said landing receptacle before said test tool is installed therein.

24. The method of claim 23, wherein said flow through said test tool takes place in a direction from said formation through said well tubing to the surface.

25. The method of claim 23, wherein said flow through said test tool takes place in a direction from the surface, through said well tubing to said formation.

* * * * *